United States Patent [19]

Stirling

[11] Patent Number: 4,562,758

[45] Date of Patent: Jan. 7, 1986

[54] VALVE AND FAUCET HANDLE TOOLS

[76] Inventor: Allan D. Stirling, 187 Sheldon Ave., Pittsburgh, Pa. 15220

[21] Appl. No.: 586,367

[22] Filed: Mar. 5, 1984

[51] Int. Cl.[4] ..... B25B 13/06

[52] U.S. Cl. ..... 81/124.4; 81/124.2; 81/124.7

[58] Field of Search ..... 81/119, 121 R, 121 A, 81/121 B, 90 B, 90 C

[56] References Cited

U.S. PATENT DOCUMENTS

| | | | |
|---|---|---|---|
| 1,321,776 | 11/1919 | Stepanian | 81/121 A |
| 1,942,492 | 1/1934 | Ratigan | 81/121 B |
| 2,445,905 | 7/1948 | Busby | 81/121 A |
| 2,735,318 | 2/1956 | Hrebicek | 81/3.48 |
| 2,758,495 | 8/1956 | Goodman | 81/90 |
| 3,048,067 | 8/1962 | Miles et al. | 81/3.1 |
| 3,186,263 | 6/1965 | Grote | 81/3.1 |
| 3,877,327 | 4/1975 | Erm | 81/121 R |

FOREIGN PATENT DOCUMENTS

| | | | |
|---|---|---|---|
| 26299 | 4/1902 | Switzerland | 81/121 B |

*Primary Examiner*—James G. Smith

*Attorney, Agent, or Firm*—Buell, Ziesenheim, Beck & Alstadt

[57] ABSTRACT

A valve and faucet handle turning tool is provided in the form of a cylindrical body having a cavity extending axially in one end thereof, a generally radially extending handle on the periphery of said body, said cavity having non-aligned indentations in the sidewall thereof at at least three different levels and at least two different diameters graduating from the open end of the cavity downwardly, and a plurality of projections extending parallel to the axis of the body on the end opposite the cavity and spaced from the cylinder axis to engage faucet handles of different configuration.

4 Claims, 8 Drawing Figures

VALVE AND FAUCET HANDLE TOOLS

This invention relates to valve and faucet handle tools and particularly to a tool capable of applying added turning leverage to most presently existing valve and faucet handles.

Valve and faucet handles used in plumbing can present very great problems to elderly persons, persons suffering from arthritis or other physical problems which make it difficult to exert the necessary leverage to open or close valves and faucets. There are also frequently situations where a valve has not been used for such a long time that it has become fixed in place due to corrosion or the like and cannot be turned by hand. Normal wrenches, pliers and the like may in some cases be used successfully to open or close such valves but their use frequently results in breakage or damage to the handle and their repeated usage almost inevitably results in breakage of the valve or faucet handle.

I have invented a tool for opening and closing valves and faucets which has almost universal applicability to all valve and faucet handles used in plumbing. It provides a sure nondamaging grip on such handles and has a lever arm which provides the necessary leverage to rotate such handles.

I provide a valve and faucet handle turning tool having a cylindrical body, a generally radially extending arm on said body, a cavity in one end of the body having indentations in the sidewall thereof at at least three levels and in at least two different diameters graduating from the top of the cavity from larger to smaller, said different indentations being adapted to engage different styles of faucets and valve handles, and a plurality of axial projections extending from said body member opposite the cavity and adapted to fit over a plurality of different faucet and valve handles. Preferably, the radial lever is provided with a recess on one side extending lengthwise thereof adapted to fit over straight arm faucet or valve handles. The tool of this invention is preferably made of rigid high strength plastic but it may be made of metal or any other suitable material such as cast iron, steel, brass, aluminum, etc.

In the foregoing general description of my invention I have set out certain objects, purposes and advantages of the same. Other objects, purposes and advantages of this invention will be apparent from a consideration of the following description and the accompanying drawings in which:

FIG. 1 is an exploded isometric view of the tool of my invention and one of the many valve and faucet handles it will operate on;

Figure 1:
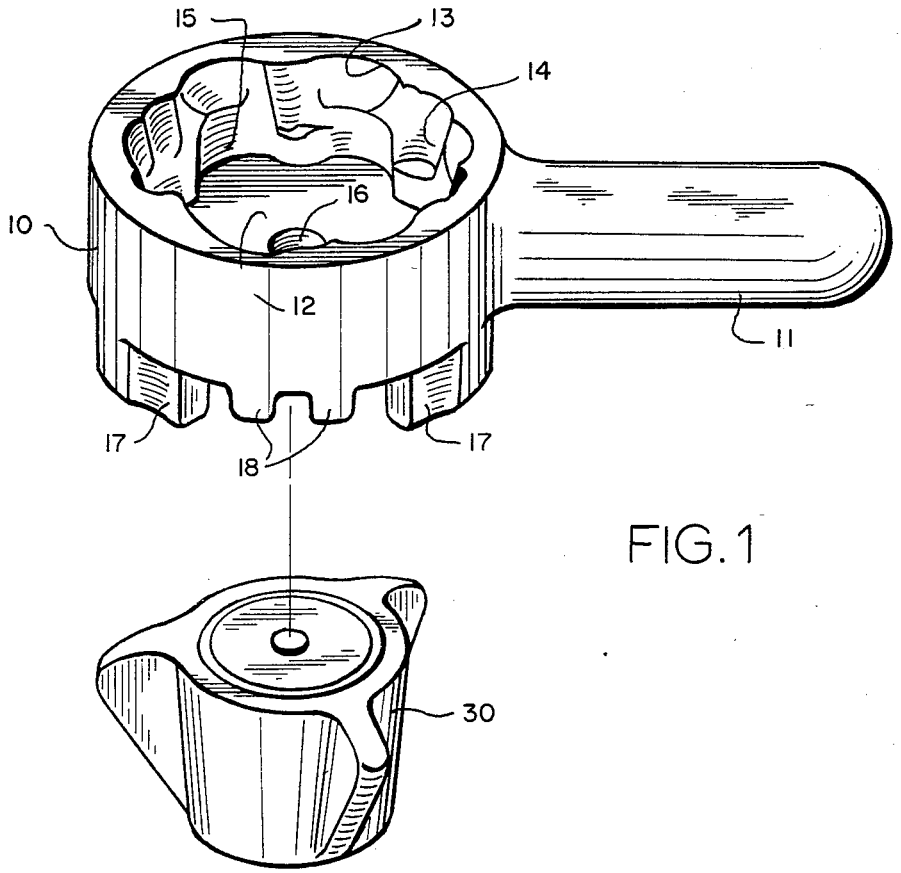
Figure 2:
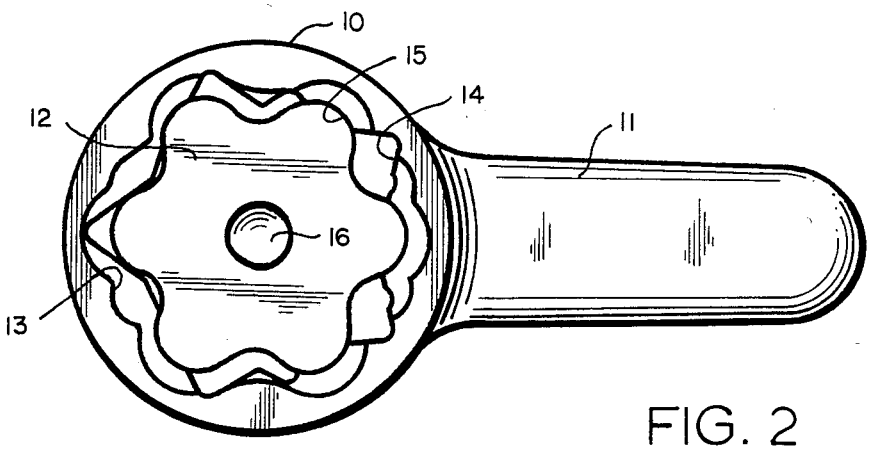
FIG. 2 is a top plan view of the tool of FIG. 1.
Figure 3:
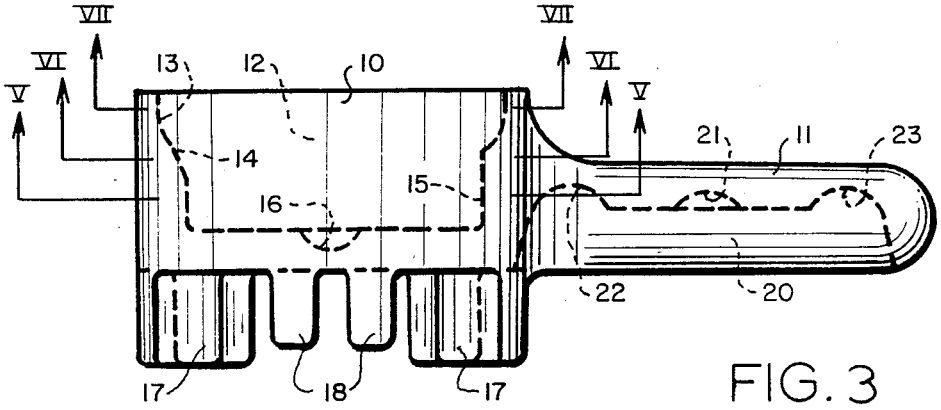
FIG. 3 is a side elevational view of the tool of FIG. 1.
Figure 4:
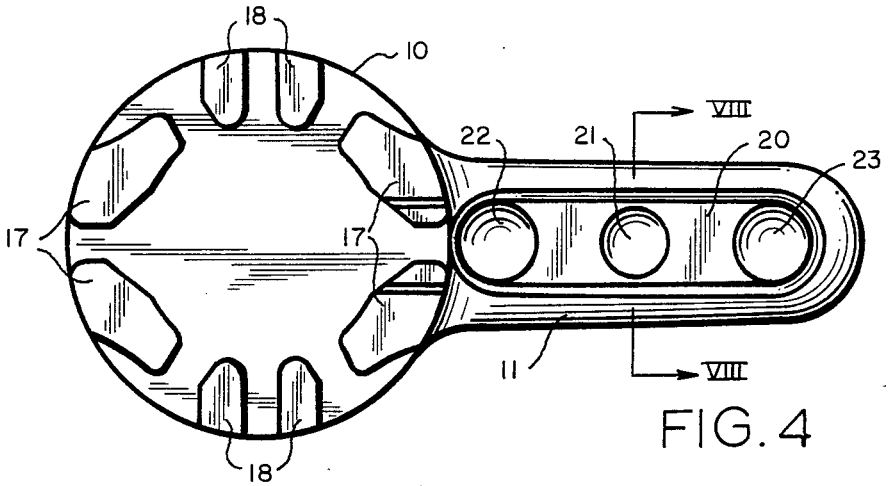
FIG. 4 is a bottom plan view of the tool of FIG. 1.
Figure 5:
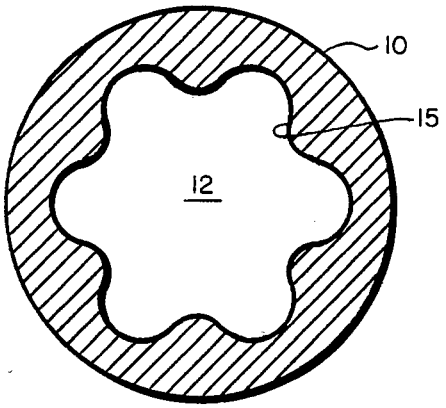
FIG. 5 is a section on the line V—V of FIG. 3.
Figure 8:
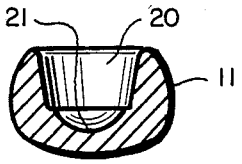
FIG. 8 is a section on the line VIII—VIII of FIG. 3.
Figure 6:
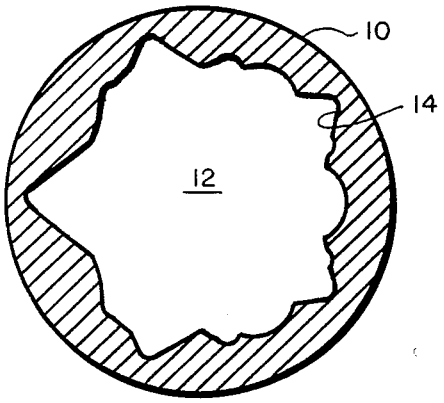
FIG. 6 is a section on the line VI—VI of FIG. 3.
Figure 7:
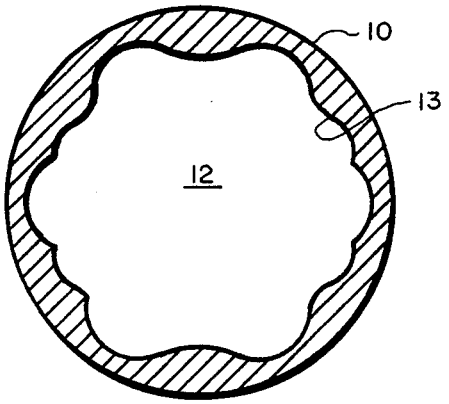
FIG. 7 is a section on the line VII—VII of FIG. 3.

Referring to the drawings I have illustrated the tool of my invention having a generally cylindrical body 10 with a radial lever arm 11 extending from the periphery. A cavity 12 having indentations 13, 14 and 15 at three different levels and at different diameters is provided in one side of the body 10. A central depression 16 is provided in the bottom of cavity 12 to accept a faucet or valve handle screw head. On the opposite side of body 10 from cavity 12 I provide a plurality of axially extending pairs of projections 17 and 18 of different shapes designed to accept different faucet and valve handles. In lever are 11 I provide on one side an elongate cavity 20 having a central depression 21 and depressions 22 and 23 at its opposite ends. Cavity 20 is designed to accept an elongate valve or faucet handle with depressions 21, 22 and 23 designed to receive the head of a fastening screw for the same.

In operation, the body 10 is turned to proper position to index either a recess in cavity 12 or a plurality of axial projections 17 or 18 over the valve handle to be turned as shown in FIG. 1 and then using the leverage of handle 11 to turn the problem handle 30.

The tool of this invention, as illustrated, is capable of engaging and turning more than 20 different configurations of valve and faucet handles presently in use to my knowledge and has in tests proven capable of turning handles with ease for arthritic persons, elderly persons and others who, without this tool, could not operate such handles or could do so only with considerable pain and difficulty.

In the foregoing specification I have set out certain preferred practices and embodiments of my invention, however, it will be understood that this invention may be otherwise practiced within the scope of the following claims.

I claim:

1. A valve and faucet handle turning tool comprising a cylindrical body having a cavity extending axially in one end thereof, a generally radially extending handle on the periphery of said body, said cavity having non-aligned identations in the sidewall thereof at at least three different levels and at least two different diameters graduating from the open end of the cavity downwardly, said indentation at each level having different configurations to engage a plurality of dissimilar shaped valve and faucet handles, and a plurality of projections extending parallel to the axis of the body on the end opposite the cavity, terminating at at least two levels and spaced from the cylinder axis to engage faucet handles of a plurality of different configurations.

2. A valve and faucet handle turning tool as claimed in claim 1 wherein the radially extending handle has an elongate cavity extending lengthwise thereof and adapted to engage an elongate faucet or valve handle.

3. A valve and faucet handle turning tool as claimed in claim 1 or 2 wherein the cylindrical body and handle are made of plastic.

4. A valve and faucet handle turning tool as claimed in claim 1 or 2 wherein the cylindrical body and handle are made of metal.

* * * * *

UNITED STATES PATENT AND TRADEMARK OFFICE

CERTIFICATE OF CORRECTION

PATENT NO. : 4,562,758

DATED : January 7, 1986

INVENTOR(S) : ALLAN D. STIRLING

It is certified that error appears in the above-identified patent and that said Letters Patent is hereby corrected as shown below:

Column 2, line 12, change "are" to --arm--.

Signed and Sealed this

*Twenty-ninth* Day of *April 1986*

[SEAL]

*Attest:*

DONALD J. QUIGG

*Attesting Officer*

*Commissioner of Patents and Trademarks*